US006128831A

United States Patent [19]

Durance et al.

[11] Patent Number: 6,128,831

[45] Date of Patent: Oct. 10, 2000

[54] PROCESS FOR DRYING MEDICINAL PLANTS

[76] Inventors: Timothy Douglas Durance, 3656 Point Grey Road, Vancouver, British Columbia, Canada, V6R 1A9; Alex N. Yousif, 19859 Wildwood Crescent, Pitt Meadows, British Columbia, Canada, V3Y 1N3; Hyun-Ock Kim, 6363 Burns St., Burnaby, British Columbia, Canada, V5E 1T3; Christine H. Scaman, Suite 204, 2700 Acadia Road, Vancouver, British Columbia, Canada, V6T 1B4

[21] Appl. No.: 09/324,881

[22] Filed: Jun. 3, 1999

[51] Int. Cl.[7] ..... F26B 5/04

[52] U.S. Cl. ..... 34/412; 34/418; 34/263; 426/102; 426/638

[58] Field of Search ..... 34/259, 263, 524, 34/527, 528, 558, 559, 575, 60, 92, 201, 202, 406, 412, 418, 493; 426/102, 639, 638, 640, 302, 303, 310; 219/678, 686, 685

[56] References Cited

U.S. PATENT DOCUMENTS

| | | | |
|---|---|---|---|
| 4,430,806 | 2/1984 | Hopkins | 34/259 |
| 4,856,203 | 8/1989 | Wennerstrum | 34/68 |
| 5,135,122 | 8/1992 | Gross et al. | 219/10.55 |
| 5,227,183 | 7/1993 | Aung et al. | 426/102 |
| 5,676,989 | 10/1997 | Durance et al. | 426/242 |

OTHER PUBLICATIONS

In Vitro Inhibition of Cyclooxygenase and 5–Lipoxygenase by Alkamides from Echinacea and Achillea Species; Planta Medica, vol. 60, pp. 37–40; Muller–Jakic et al, 1994.

Alkamides: Structural Relationships, Distribution and Biological Activity; Planta Medica, vol. 50, pp. 366–375; Greger, 1984.

Echinacea L.–Inducer of Interferons; Herba Polonica, Tom XLII, Nr2, pp. 110–117, 1996.

Echinacea–Induced Cytokine Production by Human Macrophages; Int. J. Immunopharmac, vol. 19, No. 7, pp. 371–379, 1997.

Economic and Medicinal Plant Research; Echinacea Species as Potential Immunostimularoty Drugs; vol. 5, Bauer et al. pp. 285–311; Academic Press Inc., 1991.

TLC and HPLC Analysis of Alkamides in Echinaces Drugs; Planta Medica, vol. 55, pp. 367–371; Bauer et al., 1989.

*Primary Examiner*—Pamela A. Wilson

[57] ABSTRACT

Medicinal plants are dried by applying microwave power to plant materials in a chamber under reduced pressure to reduce the moisture content of the plant materials without significantly reducing (oxidizing) the concentration of active medicinal component in the dried plant materials and thereby produce a dried medicinal plant product which more closely approaches the medicinal properties of the fresh plant than those of dried products produced by conventional air drying processes.

18 Claims, 1 Drawing Sheet

PROCESS FOR DRYING MEDICINAL PLANTS

FIELD OF THE INVENTION

The invention pertains to vacuum microwave drying of medicinal plant materials.

BACKGROUND OF THE INVENTION

Many plants contain chemical constituents which have medicinal or pharmaceutical activity and are commercially grown or gathered for that reason. Commercially important examples include St. John's wort (*Hypericin perforatum*), and echinacea (*Echinacea purpurea, E. augustifolia, or E. pallida*).

St. John'swort, *Hypericum perforatum* (L.) is a perennial herbaceous plant widespread in Europe and the Americas. The plant contains hypericin and its analog pseudohypericin and both have implications in the analgesic, antimicrobial, anti-inflammatory, antioxidant and antidepressant activities of the plant. Air-drying of the herb however reduces the level of hypericin by up to 80%, most likely as a result of oxidation (O. S. Araya and J. H. Ford (1981). An investigation of the type of photosensitization caused by the ingestion of St. John's wort *Hypericum perforatum* by calves. Journal of Comparative Pathology 135–141).

Echinacea plant materials are believed to have antiviral, antibacterial, and antifungal properties due to their non-specific enhancement of mammalian immune systems (Wagner et al 1988, Roesler et al, 1991; Steinmuller et al., 1993). Echinacea plant materials are also reported to have anti-inflammatory properties (Tubaro et al. 1987; Bauer and Wagner 1991, Muller-Jakic, 1994). Commercial plant preparations are produced from the aerial parts of *E. purpurea* and the underground parts of *E. purpurea, E. angustifolia,* and *E. pallida.* Although some uncertainly still exists as to the exact components of echinacea responsible for its medicinal activity, the group of compounds called alkamides are the most likely candidates. Alkamides are isobutylamides of highly unsaturated carboxylic acids with olefinic and/or acetylenic bonds (Greger, 1984). Using High Pressure Liquid Chromatography (HPLC), researchers have isolated and identified individual alkamides in echinacea. Bauer and Remiger (1989) identified 11 alkamides from the roots of *E. purpurea.* Different preparations of echinacea are currently in use around the world. Both fresh and dried forms of echinacea plant parts are used to make juice, powders, tablets, tinctures and capsules.

Many medicinal plant materials are unstable as they are harvested and must be dehydrated to render them sufficiently stable to be marketed or further processed. Dehydration may take the form of simple solar drying in the field but this practice renders the products susceptible to contamination by insects, microorganisms and general filth as well as the vagaries of weather. Commercial hot-air dehydrators powered by fossil fuels or electricity provide a more controlled and reliable drying option. None the less, a substantial portion of the active chemical constituents may be lost during the drying process due to the combination of high temperatures and atmospheric oxygen in the drying environment. These factors promote chemical oxidation of the active constituents, rendering them inactive, as indicated above for St. John's wort. The alkamides of echinacea, being unsaturated, that is containing double carbon bonds within their molecular structure, are likewise susceptible to destruction by interaction with oxygen. Elevated temperatures also promote oxidative reactions.

Durance and Liu, 1996. "Production of Potato Chips" U.S. Pat. No. 5,676,989 Teaches a process for simulating frying of snack foods such as potato chips by the application of microwave power under variable levels of vacuum in order to create the texture and flavor of frying without the use of vegetable oil.

Durance et al., 1998 "Process for Drying Herbs" (U.S. patent application Ser. No. 09/081,212) teaches a process for dehydrating culinary herbs in which retention of volatile flavor compounds is desirable, wherein vacuum microwave drying is employed to reduce the drying temperature and increase drying rate. In that process rapid, low temperature dehydration results in improved retention of volatile, low molecular weight flavor compounds because low temperature reduces evaporation rate of the flavor compounds and low temperature and short drying times do not allow time for the volatile compounds to diffuse out of the herb tissue into the drying chamber from hence they are lost.

SUMMARY OF THE INVENTION

It is the object of the present invention to use vacuum microwave dehydration to produce dry medicinal herbs with significantly greater retention of the essential ingredients than previously available drying methods.

Broadly the present invention relates to a process for drying medicinal plant materials with improved retention of large molecular weight, non-volatile active ingredients. The process comprises loading fresh plant materials into a vacuum microwave chamber, reducing the pressure in said chamber to a low absolute pressure below 8 inches of mercury (<0.27 atmospheres), applying microwave power at a first rate of between 1 and 12 kilowatts (kW) per kilogram of said plant material fora time period of 2 to 35 minutes to a moisture content of less than 20% based on the dry weight of the plant material without permitting significant oxidation of the non-volatile, large molecular weight active ingredients or damaging the material with excess heat.

Preferably the process further comprises applying microwave power at a lower rate than said first rate when the moisture content of the plant materials approaches 20% and completing the drying to a moisture content of 5 to 10% by applying microwave power at said lower rate.

Preferably said lower rate will be no greater the 50% of said first rate of application of microwave power.

Preferably said plant materials is one selected from a group consisting of St. John's wort and echinacea.

Preferably said herbs are tumbled or otherwise agitated within the microwave field during said time period during the application of microwave power.

Preferably said low absolute pressure in said chamber is below 5 inches of Hg, most preferably below 2 inches of mercury.

Preferably temperature in said chamber during said time period will not exceed 60° C., most preferably 40° C.

BRIEF DESCRIPTION OF THE DRAWINGS

Further features, objects and advantageous will be evident from the following detailed description of the preferred embodiment of the present invention as shown in the appended drawing.

DETAILED DESCRIPTION OF THE INVENTION

Figure 1:
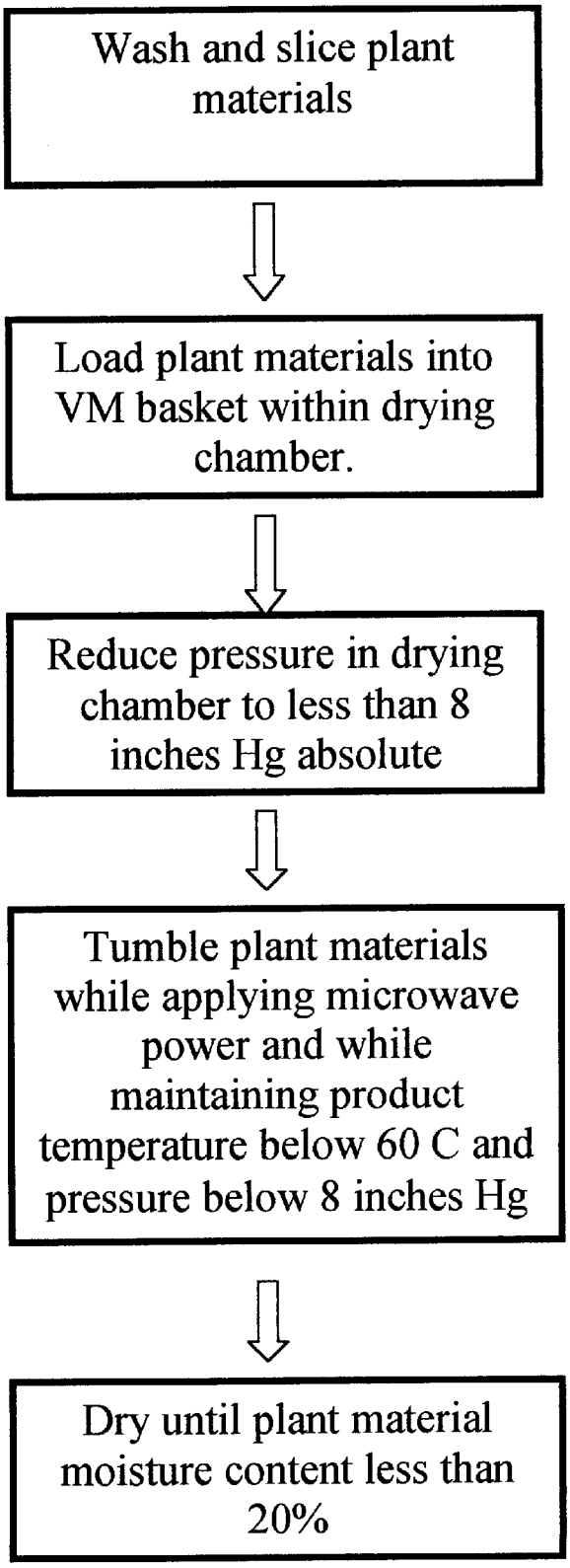
FIG. 1 is a schematic flow diagram of the preferred process of the present invention.

The active medicinal compounds in plants such as St. John's wort and Echinacea (compounds such as hypericin and alkamides) are not volatile, but instead are large molecular weight compounds and thus are not physically lost during drying due to diffusion to the tissue surface and evaporation as occurs in conventional drying of materials such as herbs and the like (see U.S. application Ser. No. 09/081,212 referred to above). . . . The conventional way to dehydrate plant materials to provide medicinal compounds such as St. John's wort and Echinacea to provide active ingredients for consumption is by air drying, however as will be shown below this is not a particularly satisfactory method of drying these products. Freeze drying is known to be more effective, but it at this point in time freeze drying is not a commercially viable solution.

The main reason for drying is to increase shelf life. These plant materials are widely used in ground form in capsules and pills. They are not generally sold fresh.

Applicants have now found a vacuum microwave dehydration process that significantly increases the retention of key active components of medicinal plants such as St. John's wort and echinacea when compared to air-drying. The present invention provides a new process for drying medicinal plants such that potency and economic value is greater than the same products when air dried and such that drying time is greatly reduced.

As illustrated in FIG. 1 the plant material is first washed and sliced, then it is loaded into the vacuum microwave drying basket and placed in the microwave drying chamber. The drying process is then started by reducing the pressure within the chamber, tumbling the material in the basket and subjecting the material to microwave energy to evaporate the moisture in the material while ensuring the temperature of the material does not exceed 60° C. and continuing the process until the material has the desired moisture content of less than about 20% by weight.

Fresh plant materials comprising roots, tubers, rhizomes, stems, leaves, flowers, fruits or seeds of medicinal plants are loaded into a vacuum microwave-drying chamber, preferably of a rotating drum type which produces more even drying, however other types of microwave dryer may be employed provided only that they achieve the required uniform drying at the required power application in the required time.

A vacuum pump is engaged to the drying chamber to produce a low absolute pressure in the chamber of below 8 inches of Hg. Absolute pressure is defined as the total gas pressure in the chamber such, that greater positive units of pressure, typically inches of Hg-pressure, reflect higher total concentration of gas in the chamber. Absolute pressure must be distinguished from vacuum which is the difference between the reduced chamber pressure and the ambient atmospheric pressure. Larger numbers of units of vacuum, typically inches of Hg-vacuum, indicate a greater difference between chamber pressure and atmospheric pressure and therefore denotes lower absolute pressure. Preferably the pressure will be reduced to below 5 inches of Hg to ensure that the boiling point of water within the chamber is below 60° C. In commercial operation it is expected that in most cases the low absolute pressure will be below 2 inches of Hg such that the boiling point of water remains below 40° C.

The higher the pressure in the chamber i.e. the less vacuum, the higher the temperature necessary for rapid evaporation of the water, the longer the drying time and the greater the concentration of gaseous oxygen in contact with the plant materials. Higher temperature, longer time and greater oxygen concentration all contribute to greater oxidation of medicinally active components in the plants and as such reduce the medicinal and economic value of the plants. It is therefore preferable to use the lowest achievable pressure and minimize the temperature, time, and oxygen concentration during drying in order to minimize the loss of medicinally active components.

Chamber pressure is determined by the capacity of the vacuum system. The vacuum system may be enhanced by increasing the size or efficiency of the vacuum pumps and also by incorporating or increasing the size of water vapor condensers into the vacuum system in order to condense water vapor evaporated from the plant materials during drying and thereby further reduce absolute pressure in the chamber.

As indicated above, pressure controls the temperature of the materials being dried; however microwave power level also influences product temperature as excessive power can evaporate water so rapidly that local pressure within the plant tissue structure may increase due to steam trapped within the plant tissue. Power levels must be low enough that steam within the tissue has time to diffuse into the chamber, such that pressure and temperature within the tissues do not reach high and damaging levels.

Uniformity of drying is maintained in the load of plant materials by adjusting the microwave power and by the position, agitation and amount of plant materials in the microwave chamber. Preferably agitation of the product is achieved by tumbling the plant materials within the drying chamber by placing the plant materials in a drum, basket or auger during the drying process. The axis of rotation of the drum basket or auger is approximately horizontal. Tumbling is preferable such that the plant materials is lifted and mixed by vanes or partitions within the drum, basket or auger so as to average the effects of non-uniform microwave field strength in the drying chamber and expose all portions of the load to similar intensity of microwave field. Other means of agitation may also be applied so long as the objective of uniform exposure of the plant materials to microwave energy is facilitated.

Microwave power is important as the higher the power the shorter the drying time but if power is to high for too long, spotty burning of the plant materials will occur, as dryer portions of the original load become dry. Generally the microwave power applied will be in the range of between 1 and 12 kW/kilogram of fresh plant material being processed. Slower drying allows more diffusion of both heat and water within the load and therefore more even drying. Too low an application of microwave power i.e. less than about 1 kW/kilogram fresh plant material is detrimental as it extends drying time of the plant materialApplication of high power i.e. greater than about 12 kW/kilogram fresh plant material makes controlling uniformity of the drying process at low moisture content (i.e. less than 20% moisture) more difficult. Generally and application of microwave power of about 4 to 8 kW/kilogram of fresh plant material is preferred and about 6 kW/kilogram of fresh plant material is most preferred.

Microwave power and vacuum are applied to the plants in the drying chamber to reduce the moisture content of the plant materials quickly and without exceeding a critical temperature of 60° C. and reducing the degree of oxidation the essential ingredients are subjected to. It is preferable to operate using the lowest pressure and the highest power provided that the power level is not so high as to damage the plant materials, so as to complete the drying at the lowest temperature and shortest time possible.

The total amount of microwave energy applied during the drying process, typically expressed in units of kilowatt hours, is important. If excess energy is applied, either by increasing the power level (kW) or increasing the process time at the same power level, the excess energy will be absorbed by the dry plant materials and cause increased oxidation of the active ingredients which is visibly recognized by scorching or burning. The correct amount of energy to apply for a given mass and given plant material may be determined by monitoring either the wet weight of the plant material during the process or by monitoring the temperature of the plant material during the process. If the initial moisture content of the plant material is known, the operator can calculate the appropriate weight at which to end the process. Alternatively the operator may monitor the plant material temperature, as this temperature will inevitably rise once the bulk of the moisture has been evaporated from the plant material and removed by the vacuum pump. Either or both temperature and wet weight of the plant material may be monitored continuously throughout each process or they may be determined in advance for a given dryer load mass and a given plant material. The process is very reproducible thus the product temperature and product total weight need not be monitored in every dehydration batch or dryer cycle.

As the moisture content is reduced control becomes more difficult and more critical thus it is preferred when the moisture content of the material reaches about 20% (25 to about 15%) to significantly reduce the amount of microwave power being applied, i.e. the microwave power is applied at a lower rate preferably of less than 50% of the normal rate of power application applied during the initial stage of drying to further reduce the moisture content of the material to between 5 and 10%.

The microwave power available for use commercially has frequency of 2450 MHz and 915 MHz, both of which may be used, but 2450 MHz is preferred.

The pressure in the chamber and the total amount of applied microwave energy (kilowatt hours) should be sufficiently low to ensure the temperature of the plant material does not exceed 60° C. and preferable for both St. John's wort and for Echinacea not above 50° C.

The drying is deemed complete when the moisture content is sufficiently low such that the equilibrium relative humidity in the sealed headspace of a container containing the dried plant material is less than 60% at 25° C.; in other words when the water activity of the plant material at 25° C. is less than 0.60. Generally this corresponds to a moisture content of plant materials between 3% and 10%. Sweeping with an inert gas such as nitrogen during the microwave vacuum drying would help remove water vapor from the chamber without promoting oxidation. In practice some air sweeping always occurs because the system is not perfectly sealed. However further sweeping with air is not deem to be helpful, as it would tend to increase oxidation. The water vapor pressure differential between the microwave drying chamber where it is being generated by evaporation and the vacuum pump causes a flow of water vapor out of the chamber.

EXAMPLE 1

Drying St John's wort using the vacuum microwave dehydration process.

Whole aerial portions (stem, leaves and flowers) of St. John's wort *Hypericum perforatum* (L) plant was collected during the flowering time in August, 1998 from various locations in Surrey, British Columbia, Canada. To facilitate even drying, the collected material was chopped into small pieces, 1–2 inches in length.

A sample (600 g) of whole St. John's wort was placed in the 10 L drying drum of a 1.5 kW, 2450 MHz frequency microwave vacuum chamber (EnWave Corporation, Vancouver, British Columbia). The initial moisture of the plant material was measured at 75.3%. The drum was rotated at a rate of 10 rotations per minute. After an absolute chamber pressure of 2 inches Hg was achieved, the magnetron was powered at 1.5 kW for 17 minutes. The product temperature was maintained at 45° C. throughout the drying period by maintaining a low chamber pressure 2 inches of Hg or less and by stopping the application of microwave power at precisely the required time. Application of microwave power in excess of that required to evaporate the water will immediately cause scorching or burning of the plant materials. The most effective way of monitoring the extent of drying is to monitor the temperature of the plant materials within the chamber by means of an infra-red thermometer or other temperature measuring device and reducing or stopping microwave power when the critical temperature is exceededThe final moisture of the dried material was 10.2%.

For air drying, a sample of the plant material was air-dried at constant temperature of 70° C., according to common industrial practice by using an air dryer with an airflow rate of 1100 L/min. After 14.5 hours in the dryer, final moisture content of 11.9% was obtained.

A third sample of the plant was freeze-dried under vacuum (0.06 inches of Hg absolute pressure) to final moisture content of 8.5%. The chamber and condenser temperatures were 20° C. and −55° C., respectively. Freeze drying is known to result in negligible oxidative losses because of the very low absolute pressure in the drying chamber and the fact that the products are sublimated dry directly from the frozen state It is known by experts in the field of drying that most biologically active compounds, aside from some dehydration-sensitve proteins, are retained immediately after freeze drying. However, freeze drying is not practical as a large scale drying method for medicinal plant materials because of its very high capital and energy costs.

For testing using High Pressure Liquid Chromatography (HPLC) analysis, samples were ground in an ultracentrifugal mill (model Retsch ZM 100, Glen Mills Inc., Clifton, N.J., USA) to pass through a 0.5 mm sieve. Samples (1 g solids) of the ground plant material were extracted at room temperature with 10 mL of methanol: pyridine (9:1), and samples (20 uL) of the filtered solution were immediately analyzed in an HPLC system (Model 1050, Hewlett-Packard), equipped with a syringe-loading sample injector, a 20 uL sample loop, and an ultraviolet spectrophotometric detection module (Model SPD-6A, Shimadzu, Kyoto, Japan). A Vydac prepacked RP-18 column 4.6 mm×25 cm (Anspec, Ann Arbor, Mich., USA) connected to an RP-18 NewGard cartridge (Applied Biosystems, Santa Clara, Calif., USA) was used. Mobile phase solution A consisted of a 70% solution of 0.1% ammonium phosphate (adjusted to pH 7.0 with sodium hydroxide) and 30% acetonitrile; solution B was 70% acetonitrile-30% water) as mobile phase. A linear gradient of 100% A to 100% B was developed over a 15 min interval with a flow rate of 1.2 mL/min, followed by 4 min of 100% B. The re-equilibration of the column was achieved by a linear change from 100% B to 100% A over the next 4 min followed by 8 min of isocratic A. Detection was in the visible range of 590 nm. Hypericin was eluted with a retention time of 16.2 min. Quantitative analysis was effected by using a standard curve obtained by injecting solutions of known concentration (50 to 500 $\mu$g/ml) of standard authentic hypericin. The linear regression coefficient of the standard curve was 0.994. Student's t-test was used to compare the mean values of the various treatments. Mean values were considered significantly different when $p<0.05$.

TABLE 1

Comparison of hypericin retention in St. John's wort dried by three drying methods as measured by HPLC.

| Drying Method | Air drying | Vacuum microwave drying | Freeze drying |
|---|---|---|---|
| Mean hypericin (mg/g solids) | 0.351 | 0.447 | 0.483 |
| Standard deviation of 3 replicates | 0.005 | 0.009 | 0.023 |

Statistical analysis showed that the hypericin retention was significantly greater with vacuum microwave drying and freeze drying than air drying while hypericin retention in vacuum microwave and freeze dried St. John's wort were not significantly different.

EXAMPLE 2

Drying echinacea using the vacuum microwave process.

Freshly harvested roots of *Echinacea purpurea* were washed with water and sliced into 3 mm thick slices using an electric slicer. Three hundred grams of root was used for each drying process.

Three hundred grams of sliced root was placed in a cylindrical perforated polyethylene basket of 10 liters volume in the vacuum microwave dryer. Maximum microwave power of the dryer was 1.5 kW of 2540 MHz frequency. For vacuum microwave drying of echinacea roots, power of 1 kW was applied for 25 minutes. Chamber pressure was at 1.7 inches of Hg. During the process the cylindrical basket was rotated on its axis at 5 RPM to tumble. The final moisture content of the vacuum microwave dried echinacea root was 7.3%. Temperature was monitored and maintained below 50° C. during the drying process Another sample of the same batch of sliced root was air dried in a Versa-Belt dryer (Wal-Dor Industries Ltd., New Hamburg, Ontario) at 70° C. for 3.5 hours. Airflow was 0.9 cubic meters/sec and relative humidity was 10%. The air-dried sample had final moisture content of 5%.

A third sample was freeze-dried (chamber pressure 0.06 inches Hg, shelf temperature 20° C., condenser temperature −55° C.) to provide an estimate of the alkamide content of the root when dried under non-oxidative conditions.

All samples were subject to HPLC analysis to determine the levels of alkamides retained in the plant material. Dried roots were ground to a powder and stored at −18° C. in sealed containers. For HPLC 1.0 grams of ground root was mixed with 10 mL of acetonitrile containing 1.0 mg N-phenylpentamide as an internal standard and homogenized. The liquid suspension was then centrifuged at 500 gravities and the supernatant was retained for alkamide analysis. One mL of supernatant was applied to a Supelclean LC- 18 extraction column (Supelco, 1 mL bed volume) which had been conditioned with 3 mL of acetonitrile and water in a ratio of 9:1. The bound alkamides were eluted with 2 mL of 9:1 acetonitrile:water and the eluants were filtered through a 0.45 μm membrane filter.

Alkamide identity and concentration in the extracts was determined with a Hewlett Packard 1050 series HPLC fitted with a Shimadzu SPD-Eav UV detector and a Vydac reverse phase RP-18 analytical column (250 mm×4.6 mm, 5 μm) with a (4 mm×4 mm, 5 μm) Anspec (Ann Arbor, Mich.) guard column. All samples were analyzed in triplicate. Alkamides were identified by comparison of retention times and UV profiles at 254 nm with authentic chemical samples. The quantities of individual alkamides was determined by comparison of peak areas from individual samples with a standard curve of HPLC peak areas obtained from known concentrations of authentic chemical standards of alkamides. Ten different alkamides (1, 2, 3, 4, 5, 6, 6a, 7, 8, and 9) were identified as reported by other workers (Bauer and Remiger, 1989).

The vacuum microwave drying process resulted in significantly higher concentrations of alkamides retained in the dry root than did the air drying process. See Table 2 for results.

TABLE 2

Comparison of retention of alkamides in echinacea dried by three drying methods as measured by HPLC.

| Drying Method | Air drying | Vacuum microwave drying | Freeze drying |
|---|---|---|---|
| Total alkamides (mg/g dry solids) | 2.85 | 3.07 | 3.28 |
| Standard deviation of 6 replicates | 0.07 | 0.09 | 0.07 |

Statistical analysis revealed that all three treatments were significantly different from each other. The alkamide content of the freeze dried sample indicates some hypericin is lost during vacuum microwave drying but that retention was still significantly better than in the current practice of air drying. Freeze-drying is not an economically feasible process for large scale drying of this product.

Having described the invention modifications will be evident to those skilled in the art without departing from the spirit of the invention as defined in the appended claims.

We claim:

1. A process for drying medicinal plant materials so that a greater portion of the key active chemical components containing non volatile, large molecular weight active ingredients are retained in the dried plant materials comprising loading cut pieces of fresh plant materials into a vacuum microwave drying chamber, reducing the pressure in said chamber to a low pressure below 8 inches of Hg absolute pressure, applying microwave power at a first rate to said materials while at said low absolute pressure with a power density of between 1 and 12 kilowatts per kilogram of said fresh plant material for a time period of from 2 to 35 minutes while maintaining the temperature of the plant materials below 60° C. to achieve an uniform drying of the plant materials to a moisture content of less than 20% based on the dry weight of the plant materials without permitting significant oxidation of said non volatile, large molecular weight active ingredients significantly damaging said plant materials by burning.

2. A process as defined in claim 1 further comprising applying microwave power at a lower rate than said first rate when the moisture content of said plant materials approaches 20% and completing drying to a moisture content less than 10% % by applying microwave power at said lower rate.

3. A process as defined in claim 2 wherein said lower rate is less than 50% of said first rate.

4. A process as defined in claim 1 wherein said plant materials are selected from a group of plants consisting of St. John's wort and echinacea.

5. A process as defined in claim 2 wherein said plants are selected from a group consisting of St. John's wort and echinacea.

6. A process as defined in claim 3 wherein said plants are selected from a group consisting of St. John's wort and Echinacea.

7. A process as defined in claim 1 wherein said plant materials are tumbled during said time period during the application of microwave power to obtain more uniform drying.

8. A process as defined in claim 2 wherein said plant materials are tumbled during said time period during the application of microwave power to obtain more uniform drying.

9. A process as defined in claim 1 wherein said low absolute pressure in said chamber is below 5 inches of Hg.

10. A process as defined in claim 2 wherein said low absolute pressure in said chamber is below 5 inches of Hg.

11. A process as defined in claim 3 wherein said low absolute pressure in said chamber is below 5 inches of Hg.

12. A process as defined in claim 4 wherein said low absolute pressure in said chamber is below 5 inches of Hg.

13. A process as defined in claim 1 wherein said low absolute pressure in said chamber is below 2 inches of Hg.

14. A process as defined in claim 2 wherein said low absolute pressure in said chamber is below 2 inches of Hg.

15. A process as defined in claim 3 wherein said low absolute pressure in said chamber is below 2 inches of Hg.

16. A process as defined in claim 4 wherein said low absolute pressure in said chamber is below 2 inches of Hg.

17. A process as defined in claim 11 wherein temperature in said chamber during said time period will not exceed 60° C.

18. A process as defined in claim 13 wherein temperature in said chamber during said time period will not exceed 60° C.

* * * * *